US008485094B2

(12) United States Patent
Anglada et al.

(10) Patent No.: US 8,485,094 B2
(45) Date of Patent: Jul. 16, 2013

(54) PRINTER ACCESSORY

(75) Inventors: Cristina Sabater Anglada, La Bisbal d'Emporda (ES); David Claramunt Morera, Sant Esteve Sesrovires (ES); Raimon Castells De Monet, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 523 days.

(21) Appl. No.: 12/774,607

(22) Filed: May 5, 2010

(65) Prior Publication Data

US 2011/0271861 A1 Nov. 10, 2011

(51) Int. Cl.
*B41F 1/34* (2006.01)

(52) U.S. Cl.
USPC ..... 101/480; 101/474

(58) Field of Classification Search
USPC ..... 101/480
See application file for complete search history.

(56) References Cited

U.S. PATENT DOCUMENTS

| | | | | |
|---|---|---|---|---|
| 2,740,374 | A * | 4/1956 | Booth et al. | 118/241 |
| 2,745,545 | A * | 5/1956 | Dunning | 206/466 |
| 3,752,722 | A * | 8/1973 | Downey | 156/201 |
| 4,662,966 | A * | 5/1987 | Sumi et al. | 156/230 |
| 5,847,739 | A | 12/1998 | Kanaya et al. | |
| 5,992,994 | A | 11/1999 | Rasmussen et al. | |
| 6,705,717 | B1 | 3/2004 | Fujita et al. | |
| 6,789,876 | B2 | 9/2004 | Barclay et al. | |
| 8,113,862 | B2 * | 2/2012 | Wei | 439/326 |
| 2003/0063173 | A1 | 4/2003 | Gonzalez | |
| 2004/0017456 | A1 | 1/2004 | Obertegger et al. | |
| 2007/0029399 | A1 * | 2/2007 | Schuster | 238/1 |
| 2008/0192075 | A1 | 8/2008 | Campion et al. | |

FOREIGN PATENT DOCUMENTS

EP 1291188 3/2003

* cited by examiner

*Primary Examiner* — Anthony Nguyen

(57) ABSTRACT

A printer accessory comprises a base having a top surface and a bottom surface, and an ink absorber having a thickness in accordance with an example of the present disclosure. The ink absorber rests on the top surface and includes an absorbent material to retain excess ink from a printing operation. Furthermore, the accessory includes print media supports connected to the base and extending beyond the thickness of the ink absorber, wherein when print media is present, the print media spans the print media supports without contacting the ink absorber. An attachment clip is connected to the base having a resiliently flexible portion to releasably secure the printer accessory to a printer.

16 Claims, 5 Drawing Sheets

PRINTER ACCESSORY

BACKGROUND

Printers are now being used to print on porous print media, such as textiles, in addition to traditional print media, such as paper. Some printers capable of printing on porous print media are not capable of printing on non-porous print media. Other printers can be converted to print on either type of print media. These printers have the advantage of versatility and can save money on equipment costs. However, the conversion process can be lengthy, difficult, and can require special tools. For commercial printers, in particular, these drawbacks can make converting from one print media type to another cost prohibitive due to money lost while the printer is out of service during the conversion. Thus, there is a need for a printer capable of printing on non-porous and porous print media that can be rapidly converted for printing on either type of print media.

DETAILED DESCRIPTION

Figure 1:
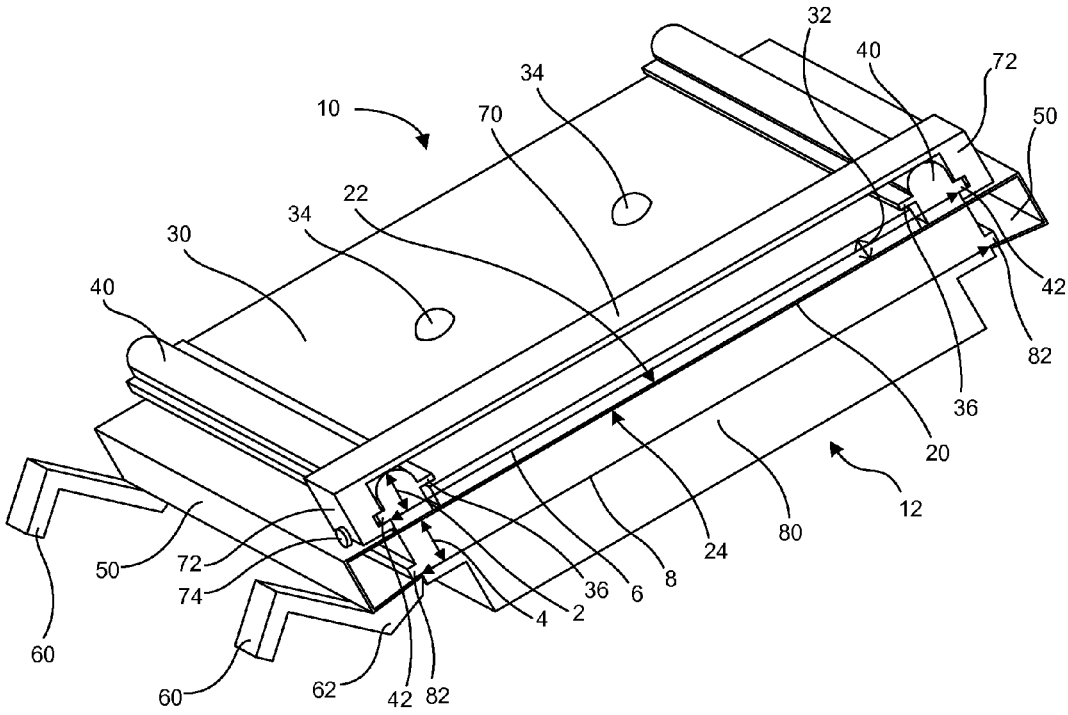
FIG. 1 is a top perspective view of a printer accessory secured to a portion of a printer in accordance with an example of the present disclosure.

Reference will now be made to certain examples, and specific language will be used herein to describe the same. Examples discussed herein set forth a printer and a printer accessory that can enable printing on porous print media. The printer and printer accessory facilitate rapid conversion from a non-porous print media set-up to a porous print media set-up. In particular examples, the conversion is accomplished without tools.

Specifically, a printer accessory can comprise a base having a top surface and a bottom surface, and an ink absorber having a thickness, the ink absorber resting on the top surface and including an absorbent material to retain excess ink from a printing operation. The accessory also includes print media supports connected to the base and extending beyond the thickness of the ink absorber, wherein when print media is present, the print media spans the print media supports without contacting the ink absorber. In this embodiment, an attachment clip connected to the base is also present having a resiliently flexible portion to releasably secure the printer accessory to a printer.

In another example, a printer system can comprise a plurality of printer accessories for printing on print media, the printer accessories including attachment clips that resiliently flex. The system also includes a printer with attachment catches that engage and flex the attachment clips of the plurality of printer accessories when the plurality of printer accessories are secured to the printer, as well as a movable stop that also resiliently flexes to indicate a gap between any two of the plurality of printer accessories secured to the printer.

Furthermore, a method of using a printer for printing on porous print media in accordance with the principles herein comprises positioning a first printer accessory proximate to a first stop of a printer, and engaging a resiliently flexible attachment clip of the first printer accessory with a first attachment catch of the printer. Additionally, the method comprises positioning a second printer accessory proximate to accessory movable stop of the printer, and engaging a resiliently flexible attachment clip of the second printer accessory with a second attachment catch of the printer, wherein a movable stop of the printer has a resiliently flexible member which indicates a gap between the first printer accessory and the second printer accessory. The method also comprises minimizing the gap between the first printer accessory and the second printer accessory.

With these general embodiments set forth above, it is noted that when describing the printer accessory, or the related system or method, each of these descriptions are considered applicable to the other, whether or not they are explicitly discussed in the context of that embodiment. For example, in discussing the printer accessory per se, the system and/or method embodiments are also included in such discussions, and vice versa.

Also, it is noted that various modifications and combinations can be derived from the present disclosure and illustrations, and as such, the following figures should not be considered limiting.

Illustrated in FIG. 1 is a printer accessory 10 secured to a printer 12. For simplicity, only a portion of the printer is shown for interfacing with the printer accessory. In this example, the portion of the printer for interfacing with the printer accessory comprises a print platen 80. The print platen includes a backing surface for interfacing with print media during printing operations. In a particular example, the printer accessory is secured over the print platen. It is noted that some printers are designed for printing on non-porous media, such as coated paper, and to some extent, plain paper which is much less porous than textiles. Other printers are designed for printing on much more porous media, such as textiles. Certain examples illustrated herein demonstrate the printer accessory attached to a printer to convert the printer from printing on non-porous or other print media to printing on much more porous print media.

In accordance with one example of the present disclosure, a printer accessory 10 for printing on porous print media comprises a base 20, an ink absorber 30, print media supports 40, and attachment clips 50. The base comprises a top surface 22 and a bottom surface 24. The ink absorber rests on the top surface of the base. The bottom surface of the base contacts or interfaces with a surface of the printer, such as a surface of the print platen 80.

Printing on porous media, such as textiles and other porous substrates, often results in excess ink dripping through the porous media, which can create a mess if not contained. In one example, the ink absorber 30 comprises an absorbent material to retain excess ink from a printing operation. A typical absorbent material, such as foam or sponge material, expands upon receiving and holding liquid. Thus, the ink absorber has a thickness 32 that varies depending on the amount of ink contained in the absorbent material. For example, a "dry" ink absorber containing no ink typically has a thickness that is less than a "wet" ink absorber that contains ink. In a particular example, ink absorber retainers 34, 36 are used to maintain the ink absorber on the top surface of the base.

Ink absorber retainers 34 are typically, for example, fasteners such as buttons, snaps, screws, bolts, nuts, or any other suitable fastener. In other examples, ink absorber retainers include hook and loop fasteners, adhesive, tape, straps, cords, clips, or any other suitable device for maintaining an ink absorber on the top surface of the base. The ink absorber retainers can allow the ink absorber to be replaced, for instance, when it is sufficiently full of ink. In some embodiments, the ink absorber retainers are permanently or removably attached to the base. In a particular example, the ink absorber retainer are permanently attached to the base by a shank that separates a head from the base by a distance roughly equal to the thickness of the ink absorber. The ink absorber can include a hole sized to allow the head of the ink absorber retainer to pass through the thickness of the absorbent material, but that does not allow the head to easily pass back through the hole, thus securing the ink absorber on the top surface of the base. Ink absorber retainers are located in any desirable location to maintain the ink absorber on the top surface of the base.

On the other hand, in another particular example, ink absorber retainers 36 are used to prevent the ink absorber from bowing or curling up at an edge of the ink absorber. As illustrated in the figure, this is done without fasteners by creating a barrier that limits deflection of the ink absorber. In a specific aspect, the ink absorber retainers are connected to the print media supports 40.

The print media supports 40 are connected to the base 20 and extend beyond the thickness 32 of the ink absorber 30. The print media supports are designed to provide that when porous print media is present, i.e. during a printing operation, the porous print media spans the print media supports without substantially contacting, if at all, the ink absorber. Thus, the print media supports are designed to such that they extend beyond the thickness of the ink absorber when the ink absorber is completely saturated with ink, in order to account for the greatest possible ink absorber thickness. Preventing contact between the porous print media and the ink absorber minimizes ink smearing on a back side of the porous print media, which minimizes ink mess and improves print quality.

In the example illustrated, the attachment clips 50 secure the printer accessory 10 to the printer. In a specific aspect, the attachment clips are connected to the base 20 and have a resiliently flexible portion to releasably secure the printer accessory to the printer, such as to print platen 80. In a particular aspect, the printer includes attachment catches 82 that engage and flex the attachment clips of the printer accessory when the printer accessory is secured to the printer. Causing the attachment clips to flex creates a force in the resiliently flexible portion sufficient to secure the printer accessory to the printer. Thus, the resiliently flexible portions of the attachment clips secure the printer accessory to the printer without the need of separate fasteners. As shown in the figure, the attachment catches of the printer are coupled to, or combined with, the print platen of the printer. In a particular aspect, the resiliently flexible portion of the attachment clips forms a cantilever spring, which is connected at one end, i.e. to the base, and has a free end that is deflected, i.e. by the printer and attachment catches. As shown in the figure, the cantilever spring of the attachment clips comprises angled or bent geometrical features. In other words, a cantilever spring need not be only a straight or linear member.

In the example shown, the printer accessory includes multiple attachment clips 50. Alternatively, a printer accessory includes a single attachment clip having a resiliently flexible portion and a different attachment device that does not flex in an appreciable manner.

Also shown in the figure, the attachment clip 50 includes handles 60 attached to the attachment clip that enhances maneuverability of the resiliently flexible portion of the attachment clip. Thus, handles can be useful in securing or removing printer accessories from the printer.

Additionally, the printer accessory includes a stop tab 62. The stop tab interfaces with a printer stop of the printer for positioning the printer accessory on the printer. In one example, the stop tab is attached to the attachment clip 50. In a particular aspect, the stop tab is attached to the handle. In a more particular aspect, the stop tab is incorporated into the handle, as shown in the figure.

As illustrated further by the example shown in FIG. 1, the attachment clips 50 and the base 20 comprise a single unitary structure. In a specific aspect, the attachment clips and the base are constructed from a single piece of material. In a more specific aspect, the attachment clips and the base are constructed from a single piece of sheet metal. Alternatively, the attachment clips and the base are separate components that are connected together by fasteners, welds, adhesives, interference-fits, or any other suitable connection for the attachment clips and the base.

When the printer accessory is not secured to the printer, a media edge guide 70 can be secured to the printer by coupling with the attachment catches 82 of the printer 12. The media edge guide is used to guide print media across the printer during a printing operation. In the example shown, the printer accessory 10 is configured to support the media edge guide when the printer accessory is secured to the printer so that the media edge guide can guide porous print media on the printer accessory during a printing operation. In one example, the printer accessory includes attachment catches 42, similar to those of the printer, which engage attachment features 72 of the media edge guide when the media edge guide is secured to the printer accessory. The attachment features of the media edge guide are configured to engage with the attachment catches of the printer accessory. In one aspect, the attachment features of the media edge guide are resiliently flexible, similar to the attachment clips. In another aspect, the attachment features of the media edge guide are rigid with no appreciable deflection in use. In a particular example for rigid attachment features, a threaded bolt 74 is used to press against the attachment catch of the printer accessory. This puts the media edge guide in tension to secure it to the printer accessory.

In a specific example, the attachment catches of printer accessory are coupled to the print media supports 40 of the printer accessory. In a particular aspect, the attachment catches of the printer accessory are located from the top of the print media supports at a distance 2 similar to a distance 4 from the top surface of the printer to the attachment catch of the printer. The print media supports are also spaced at a distance 6 similar to a distance 8 across the top of the printer. In this way, the printer and the printer accessory provide similar attachment interfaces for the media edge guide. Thus, the media edge guide is interchangeable between the printer and the printer accessory. As a result, the media edge guide can couple with the attachment catches of the printer when the printer accessory is not secured to the printer. The media edge guide can also couple with the attachment catches of the printer accessory when the printer accessory is secured to the printer. Thus, converting from printing on non-porous print media to porous print media when the media edge guide is secured to the printer comprises removing the media edge guide from the printer, securing the printer accessory to the printer, and securing the media edge guide to the printer accessory.

Figure 2:
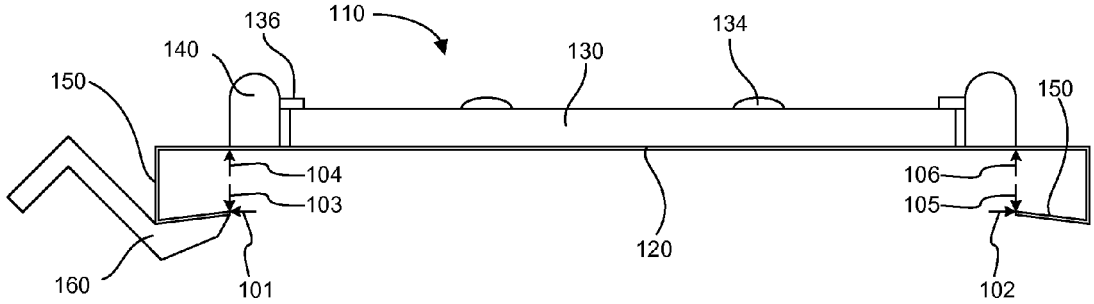
FIG. 2 is an end view of a printer accessory in accordance with an example of the present disclosure.

Referring to FIG. 2, illustrated is a side view of a printer accessory 110 for printing on porous print media shown separate from the printer. In this example, the structures shown are similar to those shown above in FIG. 1. Specifically shown are the base 120, ink absorber 130, attachment clips 150, ink absorber retainers 134, 136, and print media supports 140. When the attachment clips are engaged with the attachment catches of the printer, the attachment catches and printer produce reaction forces 101-102, 103-104, and/or 105-106 on the attachment clips and base. Forces 101-102 prevent the printer accessory from moving laterally. Forces 103-104 and/or 105-106 prevent the printer accessory from moving vertically. Thus, in this manner the attachment clips secure the printer accessory to the printer. In example, the attachment clips are designed to resiliently flex in a predictable manner. In a particular aspect, the base is designed to withstand the forces without deforming. This provides a suitable flatness to achieve desired print quality.

Figure 3:
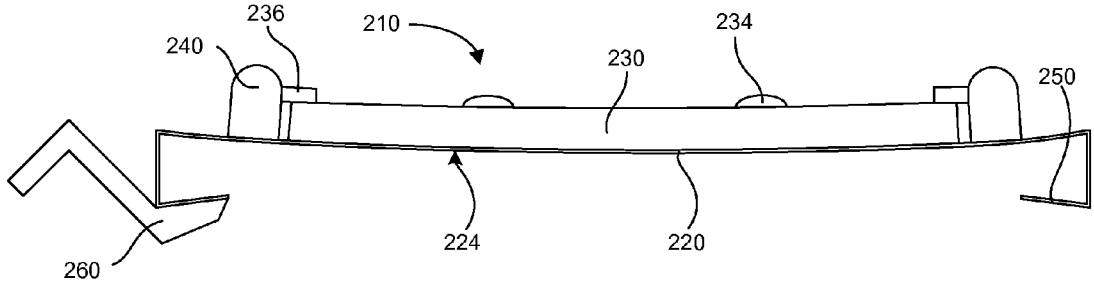
FIG. 3 is an end view of a printer accessory in accordance with another example of the present disclosure.

In an alternate example, shown at 210 in FIG. 3, again, the structures shown are similar to those shown above in FIG. 1. Specifically shown are the base 220, ink absorber 230, attachment clips 250, ink absorber retainers 234, 236, and print media supports 240. The base in this example is resiliently flexible. In a specific aspect of this example, the base is designed with a pre-curved convex bottom surface 224, so that when the printer accessory is secured to the printer, the reaction forces deflect and resiliently flex the bottom surface of the base into a desired configuration, such as a flat configuration. This provides a suitable flatness to achieve a desired print quality. In this example, the base is thin and flexible, which can reduce material costs and simplify manufacturing.

Figure 4:
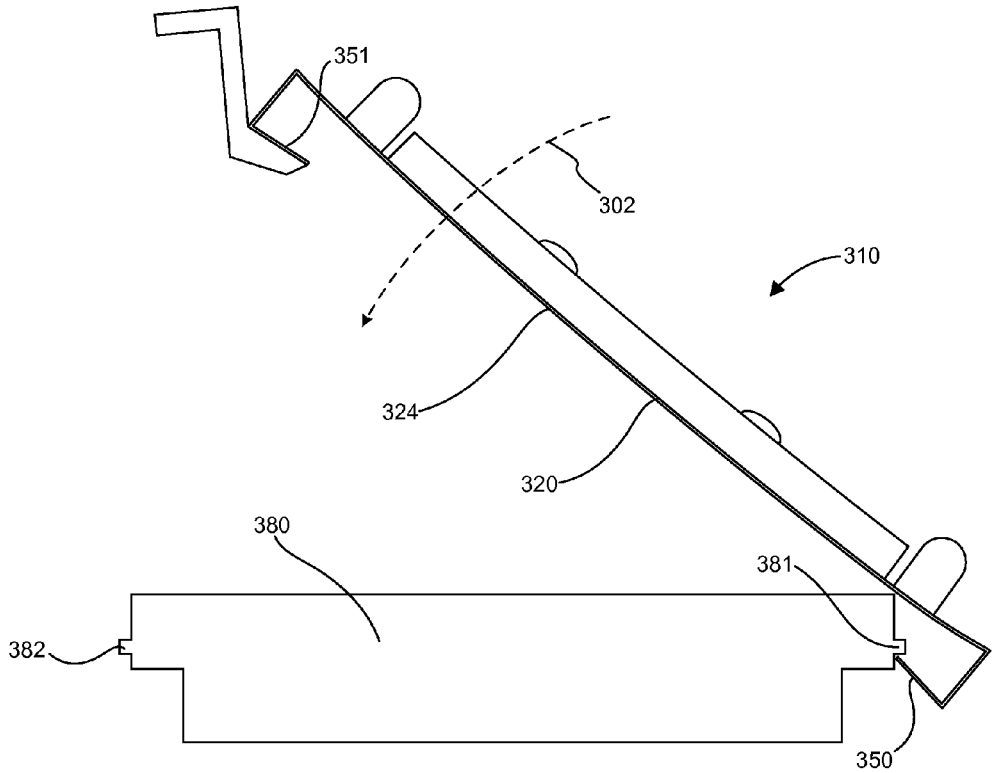
FIG. 4 is an end view of a printer accessory being secured to a portion of a printer in accordance with an example of the present disclosure.
Figure 5:
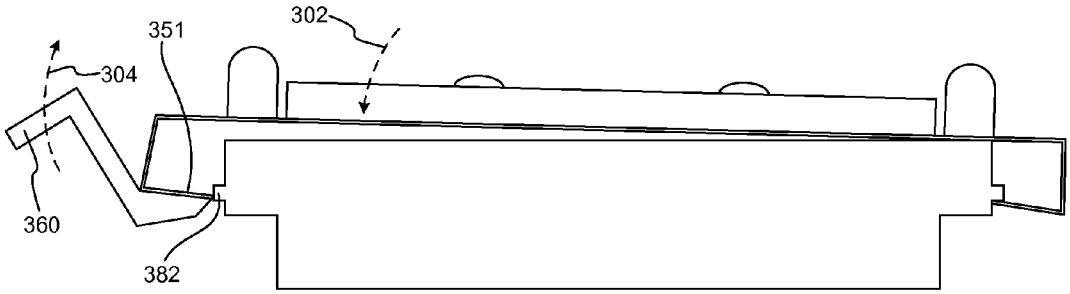
FIG. 5 is an illustration of the printer accessory being secured to the printer of FIG. 4.
Figure 6:
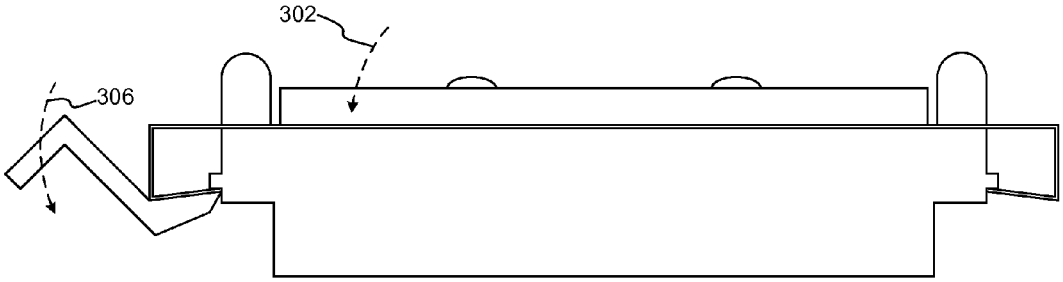
FIG. 6 is a further illustration of the printer accessory being secured to the printer of FIGS. 4 and 5.

FIGS. 4-6 illustrate a printer accessory 310 being secured to a printer, shown as print platen 380. In this example, for clarity, some but not all structures are shown as previously presented in FIG. 3. Omitted structures can also be present in this and other embodiments. In more specific detail as it relates to this embodiment, the base 320 of the printer accessory has a convex bottom surface 324. It should be understood that the printer accessory need not have a convex bottom surface, as discussed above. These figures illustrate how the printer accessory can be maneuvered to secure it to the printer 380. For example, in FIG. 4, a first attachment clip 350 of the printer accessory is positioned to engage a first attachment catch 381 of the printer. The printer accessory is then moved in a direction 302 to bring a second attachment clip 351 in a position to engage a second attachment catch 382 of the printer. Once in this position, FIG. 5 illustrates that a handle 360 attached to the second attachment clip is moved in a direction 304 to flex the second attachment clip in order to clear the second attachment catch of the printer. Concurrently or immediately following this, the printer accessory is moved in direction 302 until the second attachment clip is moved past the second attachment catch. Then the handle and attachment clip are moved in direction 306 to position the second attachment clip into a secure position over the second attachment catch, as shown in FIG. 6. The preceding steps can be done in reverse order to remove the printer accessory from the printer.

Figure 7:
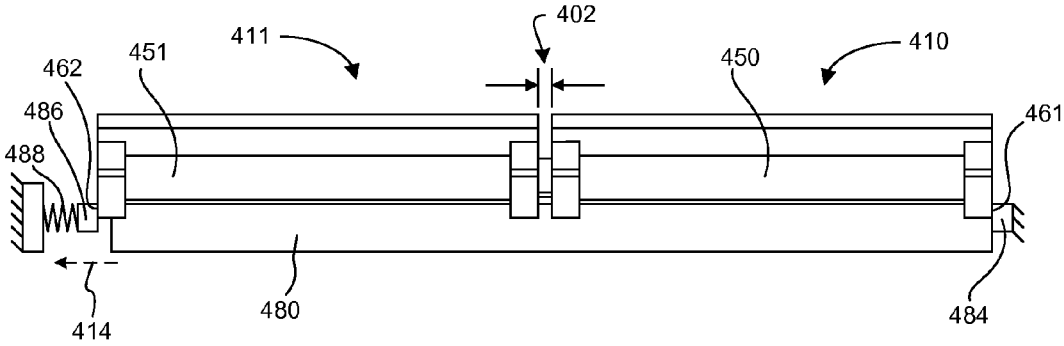
FIG. 7 is a side view of a plurality of printer accessories secured to a portion of a printer and having a gap therebetween, in accordance with an example of the present disclosure.
Figure 8:
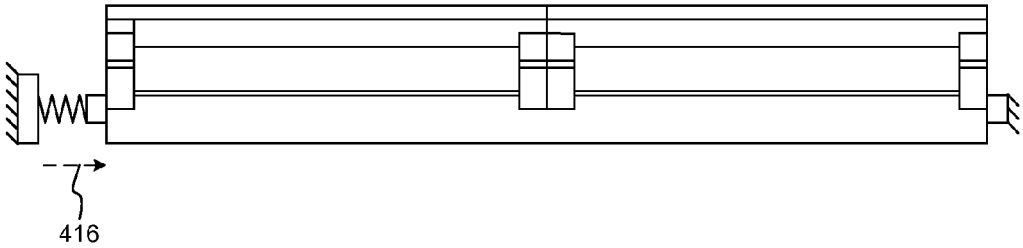
FIG. 8 is a side view of the plurality of printer accessories secured to the printer of FIG. 7 wherein the gap between them has been minimized.

Referring to FIGS. 7-8, illustrated are a plurality of printer accessories 410, 411 secured to a printer, shown as print platen 480, by attachment clips 450, 451. FIG. 7 illustrates a gap 402 between the printer accessories. In the example, printer accessory 410 is positioned proximate to a first stop 484 of the printer. The first stop engages a stop tab 461 of printer accessory 410. The first stop is a fixed stop, as shown in the figure. Alternatively, the first stop can be a movable stop, as discussed below. Printer accessory 411 is positioned proximate to a movable stop 486 of the printer. The movable stop indicates the gap between the printer accessories 410 and 411. The movable stop engages a stop tab 462 of the printer accessory 411 to indicate the gap. In one aspect, the movable stop includes a resiliently flexible member 488 to indicate the gap. In a particular aspect, the resiliently flexible member comprises a spring to enable resilient flexibility of the movable stop. The resiliently flexible member allows the movable stop to move in a direction 414 to provide space for printer accessory 411 so that it can be positioned proximate to printer accessory 410. After securing the printer accessories to the printer, the movable stop indicates that there is a gap between the printer accessories if the movable stop is not located at a predetermined location.

With the printer accessory 411 proximate to the movable stop 486, the resiliently flexible member of the movable stop exerts a force on stop tab 462 and indicates the gap between printer accessories 411 and 410. Once the gap has been indicated by the movable stop, a user can position the printer accessories to minimize or eliminate the gap. FIG. 8 illustrates direction 416 which causes the gap to be minimized or eliminated. Although the figures illustrate the example of two printer accessories secured to the printer, other than by the limits of practicality, there is no other limit to the number of printer accessories that can be secured to the printer. To illustrate, in a particular example, a printer can have eight printer accessories secured to the printer in a manner similar to that illustrated in the figures. In this example, gaps can exist between any two of the eight printer accessories secured to the printer. The movable stop resiliently flexes to indicate any such gap between any two of the eight printer accessories. With a gap indicated, a user can inspect the printer accessories for any gaps between them and can move the printer accessories to minimize or eliminate the gaps.

Figure 9:
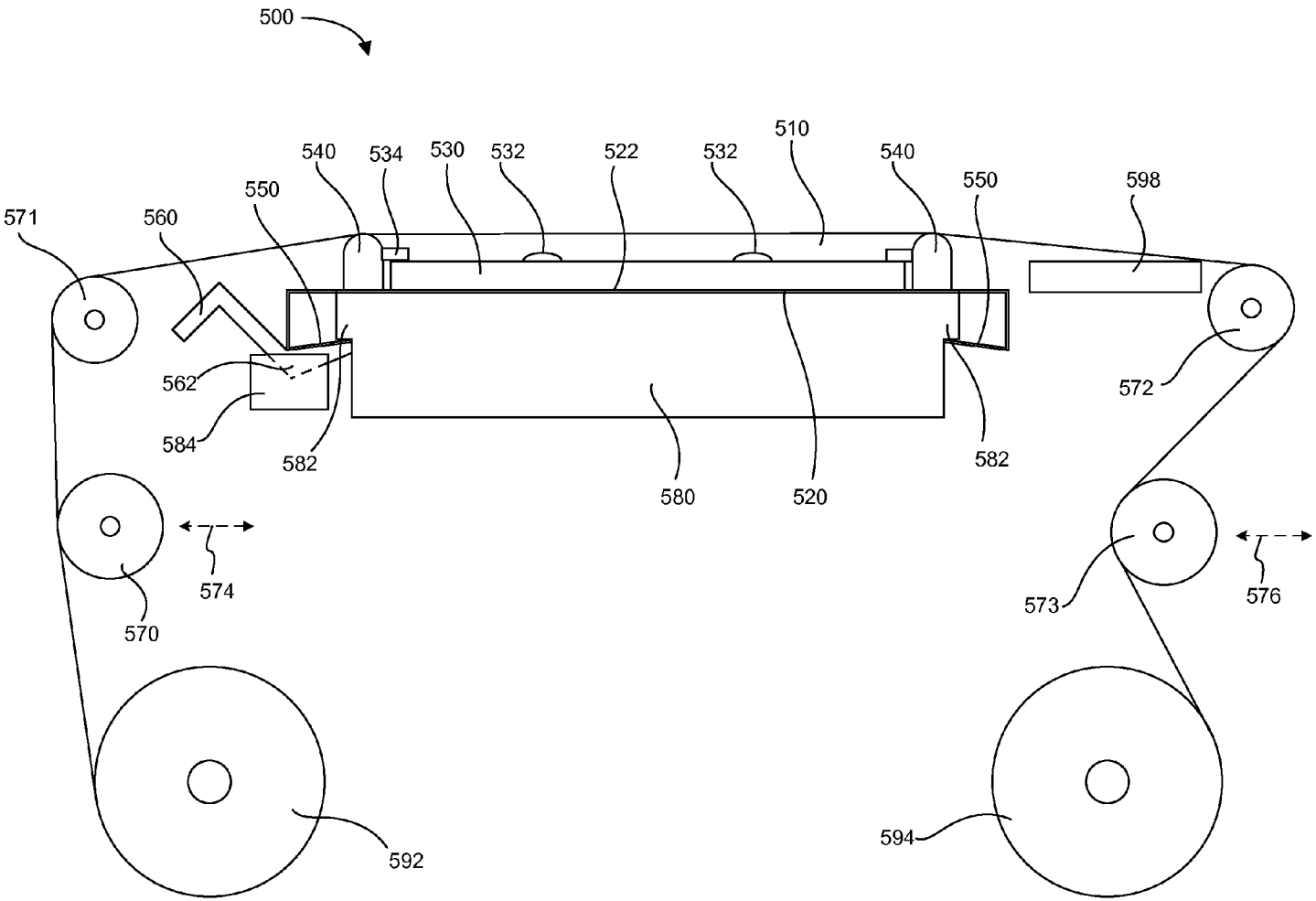
FIG. 9 is an end view of a printer system for printing on porous print media in accordance with an example of the present disclosure.

Illustrated in FIG. 9 is an end view of a schematic representation of a printer system 500 for printing on porous media. In this example, the printer system includes a print platen 580 having attachment catches 582. A printer accessory 510 for printing on porous print media is releasably secured to the print platen by resiliently flexible attachment clips 550 connected to a base 520 of the printer accessory. The attachment catches of the printer engage and flex the attachment clips to secure the printer accessories to the printer. A handle 560 is attached to the attachment clip to enhance maneuverability of the resiliently flexible portion of the attachment clips in order to ease installation or removal of the printer accessory. The printer also includes a movable stop 584 that engages a stop tab 562 of the printer accessory and resiliently flexes to indicate a gap between any two printer accessories secured to the printer.

Also shown in this example, an ink absorber 530 rests on a top surface 522 of the base 520. The printer accessory 510 includes ink absorber retainers 532, 534 to maintain the ink absorber on the top surface of the base. Print media supports 540 are connected to the base and extend beyond a thickness of the ink absorber.

The printer system in this example further includes a supply of porous print media fed from a roll 592. The print media is directed past a first wrinkle reducer 570, around a first guide roller 571, across print media supports 540, over a curing plate 598, around a second guide roller 572, past a second wrinkle reducer 573, and stored on a roll 594. The curing plate is part of a curing system that cures the ink printed on the porous print media after printing in order to fix the ink in the porous print media. As shown in the figure, when the porous print media is present, the porous print media spans the print media supports without contacting the ink absorber.

In this example, the first wrinkle reducer 570 and the second wrinkle reducer 573 are rollers that put tension into the porous print media to reduce, minimize, or eliminate wrinkles from the porous print media. The first and second wrinkle reducers move in directions 574, 576, respectively, to put tension in the porous print media. In a particular example, the wrinkle reducers are located at a fixed position to put the porous print media in tension. In another particular example, the wrinkle reducers apply a predetermined force to the porous print media to put the porous print media in tension.

Another example of the printer system 500 includes a print head that delivers ink to the print media. In this case, converting between printing on porous and non-porous print media includes moving the print head to provide clearance for the printer accessory to be installed or removed. Once the printer accessory has been installed or removed, the print head is moved into position for printing over the printer accessory or print platen, as the case may be.

Figure 10:
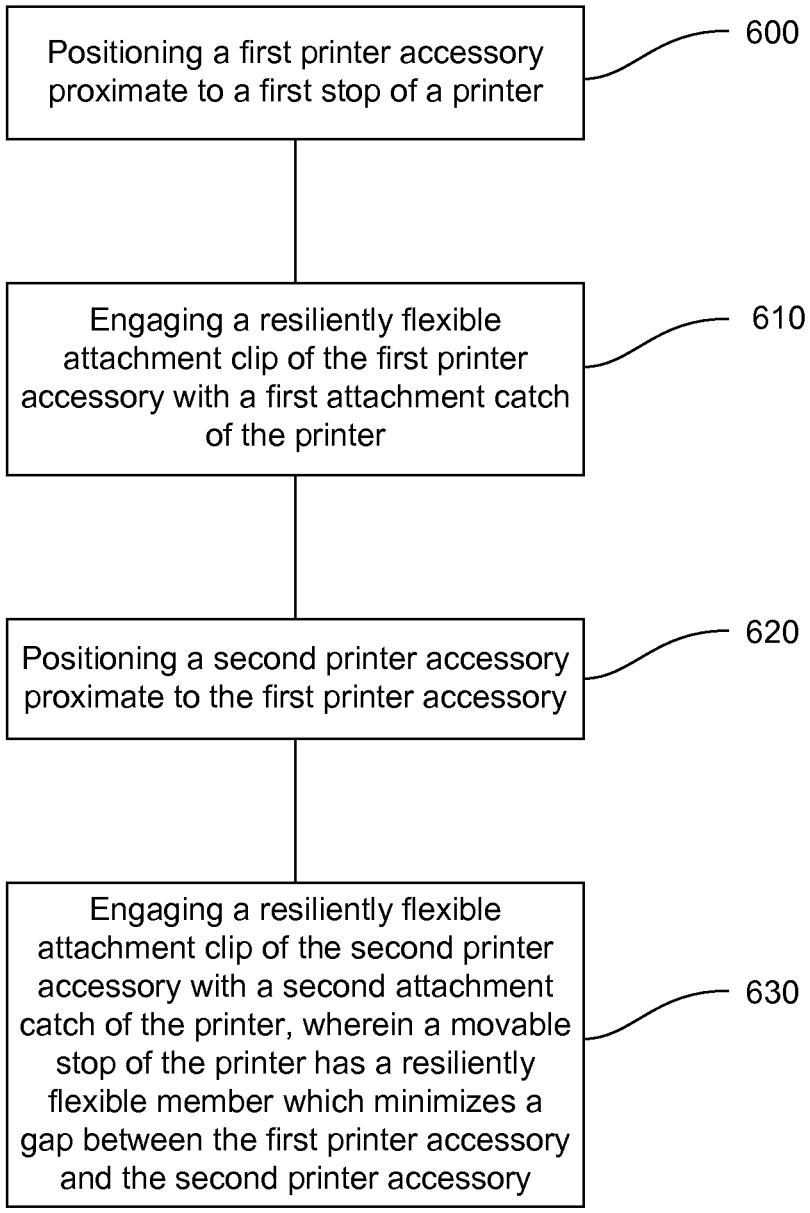
FIG. 10 is a flow diagram of a method in accordance with an example of the present disclosure.

In a related embodiment, and to reiterate to some degree, a method of using a printer for printing on porous print media in accordance with the principles herein is shown in FIG. 10. The method comprises positioning a first printer accessory proximate to a first stop of a printer 600. The method further comprises engaging a resiliently flexible attachment clip of the first printer accessory with a first attachment catch of the printer 610. Additionally, the method comprises positioning a second printer accessory proximate to accessory movable stop of the printer 620, and engaging a resiliently flexible attachment clip of the second printer accessory with a second attachment catch of the printer, wherein the movable stop has a resiliently flexible member which indicates a gap between the first printer accessory and the second printer accessory 630. The method also comprises minimizing the gap between the first printer accessory and the second printer accessory 640. It is noted that no specific order is required in this method, though generally in one embodiment, these method steps can be carried out sequentially.

In one aspect, the method further comprises positioning a porous print media over the first printer accessory. In another aspect, the method comprises positioning a roller to tension the porous print media sufficient to remove wrinkles from the porous print media. In yet another aspect, the step of positioning a print head of the printer into a printing position relative to the porous print media over the first printer accessory is carried out. In still another aspect, the method further comprises initiating a printing operation on the porous print media.

While the forgoing examples are illustrative of the principles and concepts discussed herein, it will be apparent to those of ordinary skill in the art that numerous modifications in form, usage and details of implementation can be made without the exercise of inventive faculty, and without departing from those principles and concepts. Accordingly, it is not intended that the principles and concepts be limited, except as by the claims set forth below.

What is claimed is:

1. A printer accessory, comprising:

a base having a top surface and a bottom surface;

an ink absorber having a thickness, the ink absorber resting on the top surface and including an absorbent material to retain excess ink from a printing operation;

print media supports connected to the base and extending beyond the thickness of the ink absorber, wherein when print media is present, the print media spans the print media supports without contacting the ink absorber; and an attachment clip connected to the base having a resiliently flexible portion to releasably secure the printer accessory to a printer.

2. The printer accessory of claim 1, wherein the base comprises a convex surface that resiliently flexes to become flat when the printer accessory is secured to the printer.

3. The printer accessory of claim 1, wherein the resiliently flexible portion of the attachment clip secures the printer accessory to the printer without the need of separate fasteners.

4. The printer accessory of claim 1, further comprising a handle attached to the attachment clip that enhances maneuverability of the resiliently flexible portion of the attachment clip.

5. The printer accessory of claim 1, further comprising a stop tab to interface with a printer stop of the printer for positioning the printer accessory on the printer.

6. The printer accessory of claim 5, wherein the stop tab is attached to the attachment clip.

7. The printer accessory of claim 1, further comprising an ink absorber retainer to maintain the ink absorber on the top surface of the base.

8. The printer accessory of claim 1, wherein the base and the attachment clip comprise a single unitary structure.

9. The printer accessory of claim 1, wherein the resiliently flexible portion of the attachment clip comprises a cantilever spring.

10. The printer accessory of claim 1, further comprising attachment catches that engage a media edge guide when the media edge guide is secured to the printer accessory.

11. A printer system, comprising:

a printer accessory for printing on print media, the printer accessory including an attachment clip, a base, an ink absorber and print media supports, wherein the attachment clip resiliently flexes to releasably secure the printer accessory to a printer, and the print media supports are connected to the base and extend beyond a thickness of the ink absorber, wherein when print media is present, the print media spans the print media supports without contacting the ink absorber; and the printer, including:

attachment catches that engage and flex the attachment clip of the printer accessory when the printer accessory is secured to the printer.

12. The printer system of claim 11, further comprising a media edge guide that couples with the attachment catches of the printer when the printer accessory is not secured to the printer and that couple with attachment catches of the printer accessory when the printer accessory is secured to the printer.

13. The printer system of claim 11, further comprising a roller for the print media to be tensioned sufficient to remove wrinkles from the print media.

14. The printer system of claim 11, wherein the base has a convex surface that resiliently flexes to become flat when the printer accessory is secured to the printer.

15. The printer system of claim 11, wherein the attachment catches of the printer are coupled to a print platen of the printer.

16. The printer system of claim 11, wherein attachment catches of the printer accessory are coupled to the print media supports of the printer accessory.

* * * * *